US006022014A

United States Patent [19]

Rathert et al.

[11] Patent Number: 6,022,014

[45] Date of Patent: Feb. 8, 2000

[54] ASSEMBLING MACHINE

[75] Inventors: Horst Rathert, Minden; Karl-Heinz Dopke, Rahden; Gunter Geldmeier, Stemwede, all of Germany

[73] Assignee: Kolbus GmbH & Co. KG, Rahden, Germany

[21] Appl. No.: 08/959,557

[22] Filed: Oct. 28, 1997

[51] Int. Cl.[7] ..... B65H 5/08; B65H 3/14; B65H 3/08

[52] U.S. Cl. ..... 271/11; 271/98; 271/100

[58] Field of Search ..... 271/11, 98, 100, 271/105

[56] References Cited

U.S. PATENT DOCUMENTS

| | | | |
|---|---|---|---|
| 2,282,224 | 8/1942 | Harrold | 271/98 |
| 3,071,369 | 1/1963 | Ambrogi . | |
| 3,446,498 | 5/1969 | Reist | 271/100 |
| 3,825,247 | 7/1974 | Fernandez-Rana et al. . | |
| 4,071,234 | 1/1978 | Schick | 271/11 |
| 4,397,459 | 8/1983 | Silverburg et al. | 271/94 X |
| 5,622,360 | 4/1997 | Rathert et al. . | |
| 5,813,669 | 9/1998 | Horii | 271/11 |

FOREIGN PATENT DOCUMENTS

| | | | |
|---|---|---|---|
| 598809 | 7/1934 | Germany | 271/32 |
| 1 486 744 | 8/1970 | Germany . | |
| 2 410 993 | 9/1974 | Germany . | |
| 40 21 444 A1 | 1/1992 | Germany . | |
| 42 41 855 A1 | 6/1994 | Germany . | |
| 44 37 327 A1 | 5/1995 | Germany . | |

*Primary Examiner*—William E. Terrell
*Assistant Examiner*—Kenneth Bower
*Attorney, Agent, or Firm*—Alix, Yale & Ristas, LLP

[57] ABSTRACT

A sheet feeder for use in a book assembling machine comprises a magazine having a movable base which defines a support plane for a stack of folded sheets. The feeder also includes a pneumatic separator, which creates a gap between a corner of the lowermost sheet of a stack in the magazine and the next adjacent sheet, and a device for injecting air into the thus formed gap to produce an air cushion. The movable magazine base functions as a conveyor to move, with the assistance of the air cushion, the leading edge of the lowermost sheet in the stack in a planar manner to a withdrawal conveying system where the sheet is engaged and subsequently pulled from the magazine. The withdrawn sheet moves, under the influence of a transfer mechanism in one embodiment, into registration with an assembly conveyor.

19 Claims, 3 Drawing Sheets

ASSEMBLING MACHINE

BACKGROUND OF THE INVENTION (1) Field of the Invention

The present invention relates to the manufacture of books and, particularly, to the assembling of folded pages into an ordered stack which defines an inner book. More specifically, this invention is directed to book assembly apparatus wherein pre-printed folded sheets are individually withdrawn from magazines arranged in a serial array and deposited, one on top of another, on a conveyor and, especially, to a feeder device for withdrawing a folded sheet from a magazine and delivering the thus withdrawn sheet to an assembly conveyor. Accordingly, the general objects of the present invention are to provide novel and improved methods and apparatus of such character.

(2) Description of the Prior Art

In the manufacture of books, folded pre-printed sheets are assembled, i.e., collated, into inner books which are built up in the proper page sequence on a collecting conveyor. This assembly operation requires the use of a plurality of serially arranged feeders which withdraw individual folded sheets from magazines in which they have been stacked. Such feeders, in the prior art, include a withdrawal drum and an intermediate support on which the withdrawn sheets are temporarily supported before they are deposited on a moving stack being built up on the collecting conveyor. Prior art sheet feeders also include a sheet separating device which is operated in synchronism with the withdrawal drum. The separating device has typically comprised a suction element for applying force to an edge region of the lowermost sheet in the stack to bend the edge region out of the plane of the sheet. A gripping mechanism on the withdrawal drum engages the thus separated edge region of the folded sheet and pulls the sheet from the bottom of the stack.

The folded sheets which are to be assembled into the inner book are situated in the stacked magazines with their edges in alignment, such alignment being insured by delimitation defining elements of the magazine. In the prior art, the magazine base is provided with an opening through which individual sheets may be withdrawn. The suction element which causes separation of the edge region of the lowermost sheet from an adjacent butting sheet in the stack operates in this opening and, customarily, bends or tilts a portion of the spine fold region of the sheet to a position where it may be engaged by a withdrawal drum gripper. The stack of folded sheets in the magazine, in the front edge region thereof, may be supported during the withdrawal phase of the operating cycle by stack lifters which move cyclically in synchronism with the suction elements, the stack lifters thereby preventing sagging of the stack when the partially deflected lowermost sheet is withdrawn from the magazine.

The collecting conveyor of prior art assembling machines has typically comprised a collecting channel aligned transversely with respect to the direction of withdrawal of the folded sheets from the magazines. Drivers, conventionally in the form of fingers which extend from a moving chain, project through a slot in the bottom of the collecting channel and impart movement to, while simultaneously causing edge alignment of, the ordered stack of folded pages which define the inner book being assembled. The drive fingers are sufficiently long so as to engage folded sheets which have been withdrawn from magazines and are supported above the collecting channel on the intermediate supports whereby motion in a second direction will be imparted to such withdrawn sheets and they will fall off the intermediate supports onto the moving stack. Alignment of the stack of folded sheets on the collecting conveyor is also accomplished by providing the collecting channel with an aligning edge or fence which arrests movement of the withdrawn sheets in the direction of withdrawal from the magazines.

Assembling machines which operate with a change of direction of the folded sheets withdrawn from the magazines, as briefly described above, are exemplified by the apparatus disclosed in published German Patent Application 14 86 744. In an effort to increase production rates of assembling machines of this type, mechanisms for accelerating the speed of motion of the folded sheets after withdrawal from the magazines may be employed. Such acceleration is accomplished, in the apparatus of German Application 14 86 744, through the use of reciprocating tables as the intermediate supports for the withdrawn sheets. Acceleration systems, however, increase the cost and complexity of the assembling apparatus and reduce the reliability thereof.

Assembling machines which do not require a change in the direction of motion of the folded sheets withdrawn from the magazines are also known. This type of assembling machine, as exemplified by the disclosure of U.S. Pat. No. 3,825,247 utilizes a rotational withdrawal system. Such rotational withdrawal systems employ a withdrawal drum having an axis of rotation oriented transversely with respect to the direction of movement of product on the collecting conveyor. The folded sheets are separated, closed folded edge first, from their respective magazines by a combination of pneumatic and mechanical means, rotated through an angle of 180° and deposited on the collecting conveyor.

Withdrawal systems of the type generally described in U.S. Pat. No. 3,825,247, i.e., systems with gripper drums which withdraw the folded sheets from the magazines and deposit the same in the direction of movement of the collecting conveyor, are an obvious choice if production rate is to be maximized. However, such systems have in practice been found to be of limited utility due to alignment problems. That is, in the practice of the book assembling technique of U.S. Pat. No. 3,825,247, the spines of the folded sheets will face in the downstream direction of the collecting conveyor and, accordingly, an opposite edge of each sheet will be contacted, and brought into alignment, by the drive fingers of the collecting conveyor. The folding process, however, inherently leads to inaccuracies, i.e., the two trailing edges of each folded sheet are often not in precise registration. Thus, the collecting conveyor drivers will cause the "longer" pages of each folded sheet to be aligned leading to misalignment of the folded spine edges and thus to displacement of the printed images from their desired position in the completed book.

It must also be noted that prior art feeders of the type disclosed in U.S. Pat. No. 3,825,247, which utilize gripper drums and associated suction elements, are located under the magazines. As may be seen from FIG. 3 of the patent, this positioning requires the bending of the folded sheets downwardly over a bottom edge or lip of the magazine. This has, in practice, been found to lead to failures to feed sheets, particularly when the sheets are comprised of paper with a relatively high inherent rigidity. Conversely, when the applied suction force is sufficiently high to ensure downward bending of the lowermost folded sheet in the magazine, the freshly printed folded sheets are often disfigured by marks left thereon by the separating apparatus.

When processing folded sheets which are characterized by low inherent rigidity, there is a risk that at least the second lowermost folded sheet in the magazine will be entrained by the lowermost sheet during withdrawal. Any motion imparted to such an adjacent sheet in the magazine will, at the very least, cause such sheet to become warped, a condition known in the art as "roll-up", leading to subsequent misfeed. Such feed malfunctions are particularly prevalent during the separation of folded sheets which are open at three sides and include inserted quarter sheets. In fact, depending on paper quality, print quality and climatic conditions, there is an inherent risk that the sheet located adjacent to the folded sheet being withdrawn from the magazine will either be "rolled-up" or actually be fully withdrawn as a result of friction between the top page of the lowermost sheet and the bottom page of the adjacent sheet or as a result of the attraction between the abutting pages caused by a build-up of static electricity or as a consequence of adherence between the print on the two facing pages. Either a missing sheet malfunction resulting from a rolled-up sheet or a double feed is highly undesirable in that it will lead either to waste or a production stoppage.

SUMMARY OF THE INVENTION

The present invention overcomes the above-briefly discussed and other deficiencies and disadvantages of the prior art and, in so doing, provides an inner book assembling technique, and apparatus for the implementation thereof, which is characterized by improved operational reliability and reduced equipment cost. The present invention is also characterized by enhanced operator control and the ability to increase production rate when compared to the prior art.

An inner book assembling machine in accordance with the invention will, as in the past, have a row of feeder stations. Each feeder station will comprise a magazine for receiving a stack of folded printed sheets, a device for separating the lowermost folded sheet from the stack in the magazine and, optionally, an intermediate support for the separated folded sheets. The assembling machine will also, as is conventional, include a collecting conveyor comprising a collecting channel and associated, relatively movable, drivers. The separating devices of the present invention each include a movable magazine base and pneumatic apparatus which cooperates with this movable base to separate the lowermost folded sheet in the magazine from the stack in the magazine and deliver the thus separated sheet into engagement with a withdrawal conveyor positioned intermediate the supply of folded sheets, i.e., the magazine, and the collecting conveyor channel.

In the practice of the present invention, the products being manipulated, i.e., the individual folded sheets, are moved gently and reliably and, accordingly, waste is minimized because the folded sheets are not marred while malfunctions, i.e., misfeeds, in the assembling process are minimized. These advantages are achieved simultaneously with a reduction in the cost and complexity of the assembling apparatus. Thus, in the practice of the invention, other than conveying means, which function as the magazine bases to cyclically advance the lowermost folded sheet in the magazine, and a pair of pneumatic operators, which accomplish the sheet separation, no mechanical motion controls are required. The operational reliability of the present invention results, at least in part, from retention of the plane of motion of the folded sheets being separated from the magazine during the actual separation process and by the creation of an air cushion between the lowermost folded sheet and the remainder of the stack. Accordingly, "dragging along" of the folded sheet adjacent to the lowermost sheet, i.e., the so-called "roll-up", will not occur and sheet feed failure is minimized. Considered from a volummetric efficiency standpoint, because the overall height of the assembly machine is reduced in the practice of the present invention through elimination of the withdrawal drum of the feeder, the feeding height of the withdrawn folded sheets is ergonomically advantageous and, as an added benefit, the folded sheet magazines may be loaded from both sides.

When the present invention is embodied in an assembling machine having feeders which deliver the folded sheets withdrawn from the magazines to the collecting conveyor in the direction of motion of products being propelled along the collecting conveyor, i.e., with no change in the motion direction of the folded sheets subsequent to extraction from the magazines, the present invention permits a substantial increase in production rate, i.e., the time to assemble an inner book is significantly reduced.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENTS

Figure 1:
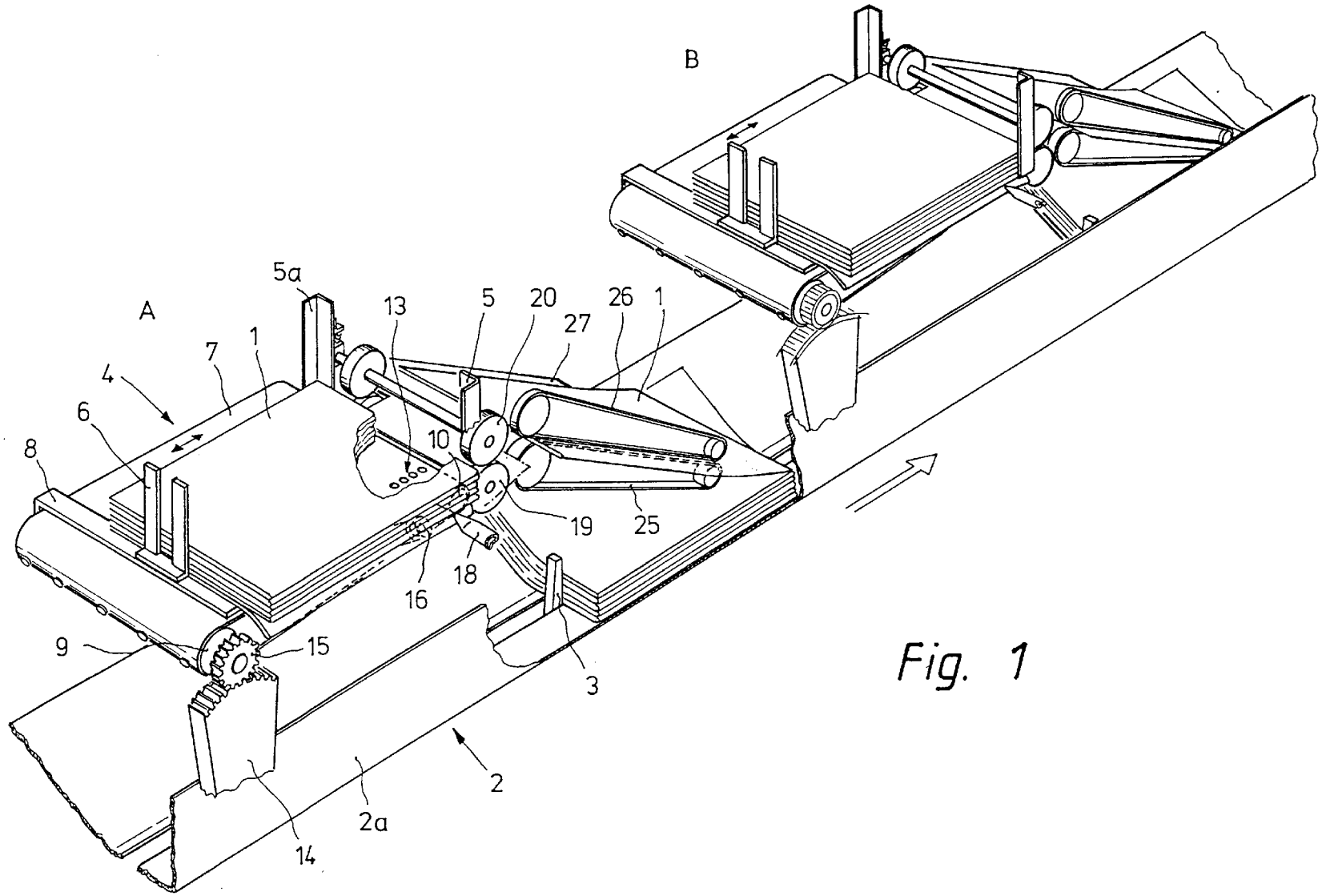
FIG. 1 is a partial perspective view, partly broken away to reveal detail, of a first embodiment of an assembling machine in accordance with the invention.

An inner book assembly machine in accordance with the present invention includes a conventional collecting conveyor. Referring to the drawings, the collecting conveyor comprises a channel 2 which is delimited on one side by a vertical wall or alignment fence 2*a*. The base of channel 2 is provided with an elongated slot, running parallel to wall 2*a*, in which drivers 3 of a chain conveyor (not shown) move. The drivers 3 are arranged at defined distances from one another. The assembly machine, as is conventional practice, will also include a serial array of sheet supply stations disposed along the collecting conveyor. The supply stations are, in the disclosed embodiments, spacially separated by a distance which corresponds to the distance between the drivers 3. In the embodiment of FIG. 1, a pair of supply stations are indicated at A and B whereas, in the embodiment of FIG. 3, a pair of supply stations are shown at C an D. In actual practice, the number of active supply stations will be determined by the number of pages in the inner book which is to be assembled.

Each of the sheet supply stations A–D comprises a magazine, indicated generally at 4 in FIG. 1, for receiving a stack of folded sheets 1. Each of sheets 1 will typically have been printed and thus will define four indicia bearing pages. The dimensions of the magazines are fixed by locating angles 5, 5*a* which are positioned at the front of the magazine as viewed in the direction in which folded sheets 1 move when withdrawn from the magazines. One of the locating angles, angle 5 in the disclosed embodiments will be fixed in position while the position of the other locating angle will be adjustable whereby the magazine may accommodate folded sheets having different formats. The magazines 4 are further defined by rear stop rails 6. The stop rails 6 are carried by a support rail 8 which is also adjustable to accommodate different size sheets. As will be described in greater detail below, the planar base of each magazine 4 is movable and thus defines a conveyor. In the disclosed embodiments, the magazine bases are in the form of movable belts 7. The adjustable rails 8 are disposed slightly above the surface of associated belts 7 and span the belts. The locating angles 5, 5*a*, and additionally pass rails 11 (see FIG. 3), are vertically adjustable. The vertical position of angles 5 and 5*a* and rails 11 will be set so as to define a gap between the plane of the upper surface of belt 7 and a plane defined by the lower edges of the angles and pass rails which is commensurate with the thickness of a single folded sheet 1.

Figure 3:
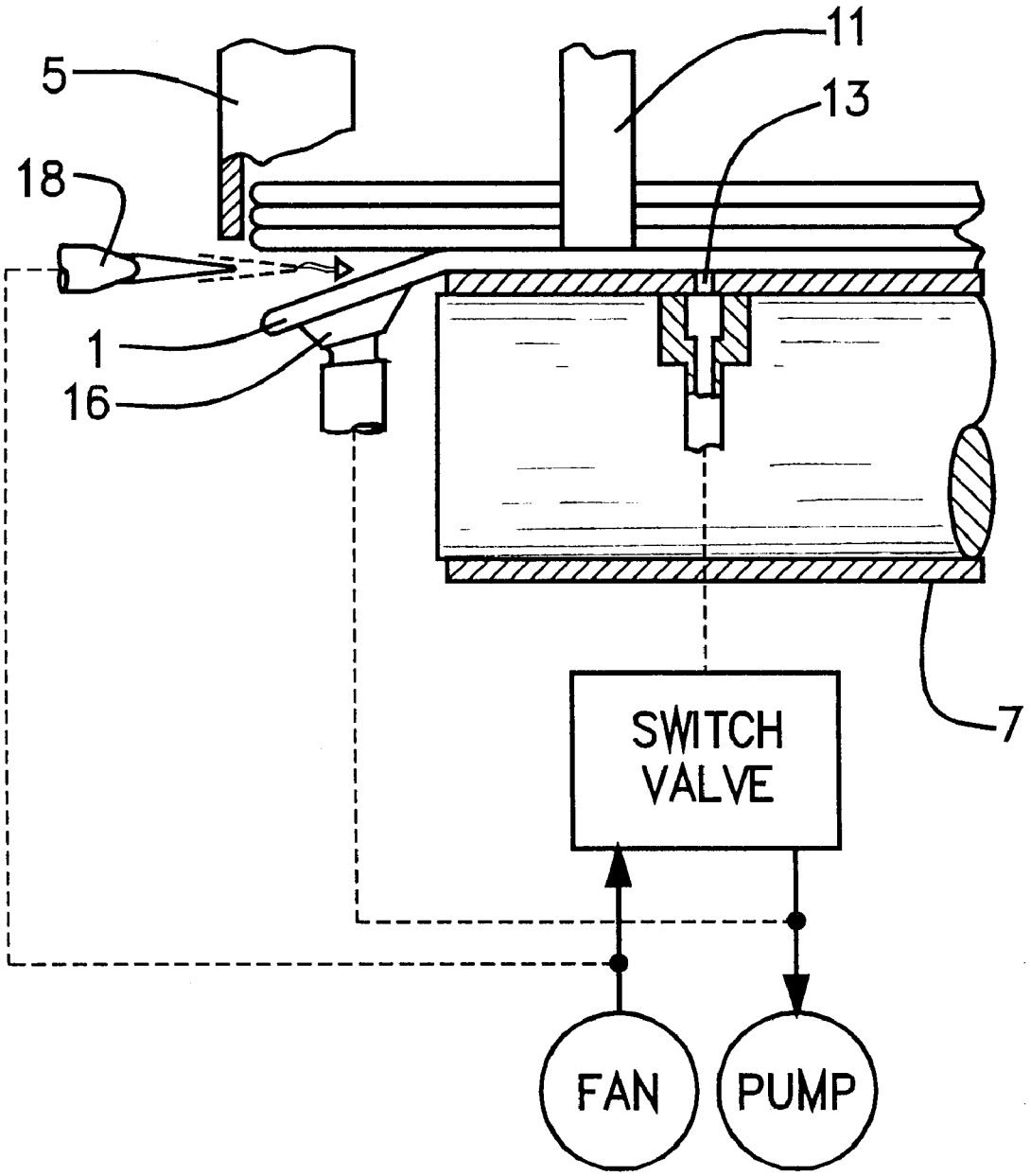
FIG. 3 is a schematic side elevation view, partly in section, which shows details of the sheet separating mechanism of the embodiments of FIGS. 1 and 2.

Referring to FIGS. 1 and 3, the location of a first side edge of belt 7 relative to locating angle 5 is selected so as to provide an area where the folded sheets 1 project a defined distance beyond the edge of belt 7. This projection enables, in the manner to be described below, a deflecting force to be applied in the edge region of the lowermost folded sheet in a magazine whereby a portion of the sheet may be bent downwardly relative to the plane of the upper surface of belt 7. This downward deflection is, in the disclosed embodiments, produced in the region of a front corner of a folded sheet viewed in the withdrawal redirection. This front corner of a sheet 1 is in part defined by the fold or spine of the sheet.

The belt 7 is a cyclically reciprocating conveyor belt with a non-slip surface. Belt 7, in the disclosed embodiments, passes about rollers 9 and 10 and is fastened to roller 9. Roller 9 is driven, so as to impart reciprocating motion to belt 7 as indicated by the double-headed arrows, by means of driven gear segments 14 which engage pinion gears 15 affixed to rollers 9.

The folded sheets 1 are stacked in the magazines 4 so as to be supported on the belts 7 and vertically aligned by the locating angles 5, 5*a* and the stop rails 6. The magazines are loaded such that the folds of the sheets 1, i.e., the spine folds, face the vertical wall 2*a* of the collecting channel 2.

In order to separate and subsequently withdraw the bottom folded sheet 1 from a stack in a magazine 4, a front corner of this sheet which projects beyond the belt 7 must be effected. Referring to FIG. 3, in the practice of the present invention, the projecting corner region of a folded sheet 1 is "engaged" by means of a suction element 16 which is connected to a low pressure source such as a vacuum pump. The suction element 16 is movable, by means not shown, in synchronism with the motion of the conveyor belt 7 which, as noted, defines the stack supporting base of the magazine. The suction element 16, in the conventional manner, causes the front corner region of the lowermost sheet 1 in the magazine to be separated from the adjacent sheet and tilted downwardly as shown in FIG. 3. This displacement of the corner region will define a gap into which air will be injected between the lowermost sheet in the stack and the adjacent sheet via a pressurized source 18, the source of pressurized air being depicted as a nozzle. The injected air will reduce the friction between the lowermost folded sheet and the adjacent sheet in the stack. Accordingly, motion may be imparted to the lowermost sheet without moving the adjacent abutting sheet whereby the lowermost sheet may be withdrawn from the magazine. Mechanical drive means, not shown, allow the nozzle 18 to move, as indicated by the broken line showing of FIG. 3, in synchronism with the motion of belt 7 and suction element 16, i.e., the source of pressurized air moves into the separation created between the lowermost folded sheet and the immediately adjacent sheet disposed thereabove and, in so doing, both creates an air cushion between the sheets and functions as a support for the stack of folded sheets in the magazine in the spine regions thereof.

Belt 7 is provided with an array of apertures 13 which may be pneumatically coupled to a low pressure source whereby the belt 7 can function as a vacuum conveyor. Because of the friction between the surface of belt 7 and the lowermost sheet 1 in the stack, and further as a consequence of the operation of belt 7 as a vacuum conveyor, the lowermost folded sheet 1 will move with the belt 7. Thus, the imparting of rotation to the rear roller 19 will cause the belt to move in the forward, i.e., withdraw and delivery, direction and the motion of belt 7 will be translated into a component of forwardly directed force applied to the lowermost folded sheet in the magazine. Forward motion of belt 7 will advance the leading edge of the lowermost folded sheet 1 into engagement by a withdrawal conveyor system interposed between the supply station and the collecting conveyor. This withdrawal conveyor includes driven rollers 19 and spring mounted counter-pressure rollers 20, the nip of the cooperating rollers being substantially coplanar with the advancing sheet 1. The forward movement of belt 7 will thus result in the lowermost sheet 1 moving in a substantially planar manner and, as the belt 7 passes around roller 10, the leading edge of the sheet will detach therefrom and will move into the nip of rollers 19, 20. Rollers 19 are driven at an accelerated speed relative to the forward motion of belt 7.

Once the withdrawal conveyor has engaged the folded sheet 1, belt 7 will reverse its direction and move back into its starting position so as to be ready to advance the next folded sheet in the stack. During the reverse motion of belt 7, the air supply to the holes 13 in belt 7 is preferably reversed, i.e., rather than being coupled to a low pressure source, the holes 13 are coupled to a source of pressurized air via a switching valve. This "switchover" results in the production of an air cushion between belt 7 and the stack in the magazine and thus reduces friction. During the return of belt 7 to its starting position, the folded sheet stack in the magazine is prevented from motion by its engagement with the rear stop rails 6 of the magazine.

The withdrawal conveyor bridges the height difference between belt 7 and the collecting channel 2 of the collecting conveyor. In the FIG. 1 embodiment, in order to ensure the transfer of the withdrawn folded sheets onto the collecting conveyor, a transfer conveyor having a lower belt 25 and an upper belt 26 is provided. Belts 25 and 26 are driven at the same speed as the withdrawal rollers 19 and engage the separated folded sheet 1 close to the spine thereof. During the transfer operation, that part of the folded sheet 1 located between, and thus engaged by, belts 25 and 26 is supported on an inclined table 27. The inclination of belts 25 and 26 and table 27 is adjustable so that the discharge end of the withdrawal conveyor is in close proximity to the height of the previously assembled sheet stack moving along the collecting channel 2 under the influence of the drivers 3.

Figure 2:
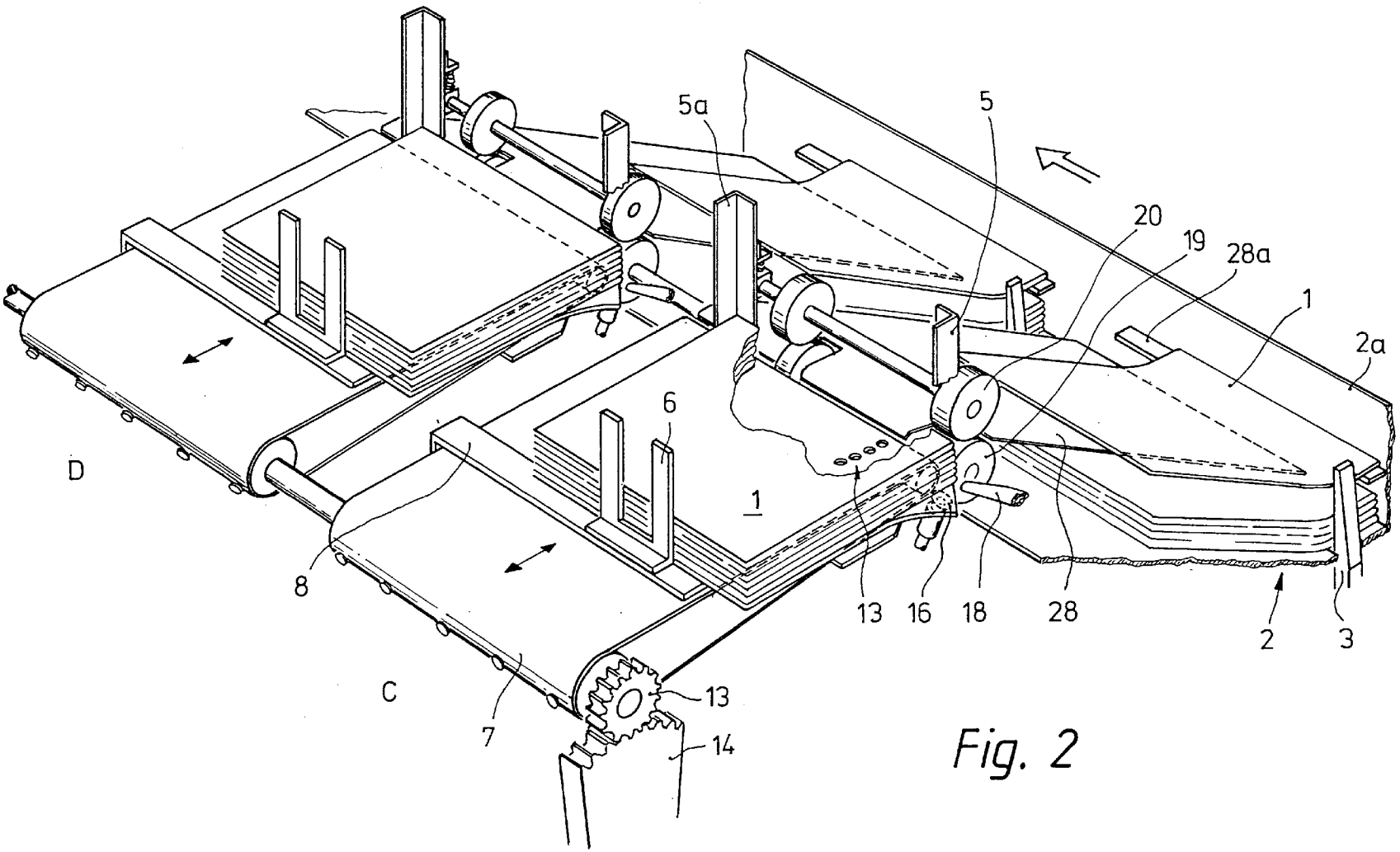
FIG. 2 is a partial perspective view, also partly broken away, depicting a second embodiment of an assembling machine in accordance with the invention.

The embodiment of FIG. 1, as described above, operates without a change in the direction of the separated folded sheets. FIG. 2 depicts a second embodiment of the invention which operates on the same principal for separating the folded sheets as described above. However, in the FIG. 2 embodiment the separated sheets initially move in a direction transverse to the running direction of the collecting conveyor. While the magazines and sheet separators of the FIG. 2 embodiment are displaced both laterally and vertically from the collecting conveyor, as opposed to only vertical displacement as in the FIG. 1 embodiment, the physical space required for operation of the FIG. 2 embodiment is much less than that necessitated by the separating mechanisms employing withdrawal drums of the prior art.

The withdrawal conveyor of the FIG. 2 embodiment, rather than employing the inclined table 27 and the cooperating belts 25 and 26, utilizes intercepting plates 28 and 28*a* which are adjustable as a function of the height of the stack assembled in collecting channel 2 upstream of the intercepting plates. Separated folded sheets 1 will be accelerated by cooperating rollers 19, 20 and guided downwardly on plate 28 and into contact with the wall 2*a* which delimits the channel 2. The folded edges of the separated sheets will, when in contact with wall 2*a*, be supported on plate 28*a*. A space for movement of the drivers 3 is defined between facing edges of plates 28 and 28*a*. Accordingly, a folded sheet temporarily supported on plates 28, 28*a* will be engaged by a driver 3, pushed in the downstream direction and will fall off the plates and onto the moving stack. For optimized feeding of folded sheets which comprise small format books, it is possible to eliminate the intercepting plate 28*a* and employ the cooperating belts 25, 26 of the FIG. 1 embodiment.

It will be appreciated that the orientation of the folded sheets in the magazines is preferably different in the embodiments of FIGS. 1 and 2. This difference in orientation is dictated by the desirability of bringing the spine folds of the sheets into alignment by establishing contact between the folded edges and the vertical channel defining wall 2*a*. In both disclosed embodiments of the invention, preliminary separation by means of the suction element 16 is effected at the corner of the folded sheets defined by the junction of the top edges of the pages and the fold. The coordination of separation and take-over by the drivers 3 of the collecting conveyor will be identical irrespective of book format, i.e., the drivers 3 will engage the top edges of the pages.

As will certainly be appreciated by those skilled in the art, the conveyor belts 7 of all of the magazines 4 may be coupled for drive purposes. Likewise, the withdrawal conveyor feed rollers 19 may all be mechanically coupled.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Improved apparatus for feeding folded sheets of paper from a stack thereof in a first, frontal direction to a book assembly conveyor, the feeding apparatus cooperating with other like apparatus and the assembly conveyor to form an ordered consolidation of folded sheets, said feeding apparatus comprising:

a magazine for receiving a stack of folded sheets, said magazine including a movable base for supporting the stack, said base defining a support plane and being dimensioned to provide an open area in which the stack will be unsupported, said open area being at least in part in registration with a lateral edge region of the lowermost sheet of the stack in the magazine, said open area encompassing at least a portion of the fold in the lowermost sheet, said magazine having a sheet discharge opening, the motion of said base in said first direction generating a force component directed toward said discharge opening, said force component being coupled to the lowermost sheet in said magazine whereby the lowermost sheet may be moved relative to the remainder of the stack to cause a front edge region thereof to pass through said discharge opening;

a movable pneumatic sheet separator for generating a sheet deflection force, said sheet separator operating through said open area of said magazine base to cause the deflection of a portion of the lowermost sheet of the stack in said magazine away from said support plane whereby said deflected portion of said lowermost sheet is separated from an adjacent sheet in the stack in said magazine;

means for producing an air cushion between at least a part of the upper surface of the lowermost folded sheet of the stack in said magazine and at least a part of the lower surface of an adjacent sheet in the stack, said air cushion producing means operating subsequent to said partial deflection of the lowermost sheet to inject pressurized air into the space between the lowermost and adjacent sheets, said air cushion facilitating movement of the lowermost sheet relative to the adjacent sheet in response to movement of said magazine base; and a withdrawal conveyor positioned adjacent said magazine discharge opening, said withdrawal conveyor engaging the front edge of a sheet moved through said discharge opening and withdrawing the engaged sheet from said magazine.

2. The apparatus of claim 1 wherein said movable base of said magazine is provided with an array of openings and said apparatus further comprises:

means for delivering pressurized air to said openings in said movable magazine base whereby motion of said base in a second direction opposite to said first direction and relative to a stack of sheets received in said magazine will be facilitated by establishment of an air cushion in at least a part of the region between said base defined support plane and the lowermost sheet of a received stack.

3. The apparatus of claim 1 wherein said movable magazine base is provided with an array of apertures extending therethrough and wherein said apparatus further comprises:

means for selectively drawing air through said apertures of said array or delivering pressurized air to said apertures of said array whereby said movable base functions as a vacuum conveyor during motion in said first direction and produces an air cushion between said base defined support plane and a stack of folded sheets in said magazine during motion of said base in a second direction opposite to said first direction.

4. The apparatus of claim 1 wherein said withdrawal conveyor comprises:

rollers for frictionally engaging a folded sheet moving in said support plane through said magazine sheet discharge opening and accelerating the speed of movement thereof.

5. The apparatus of claim 1 wherein the assembly conveyor defines a linear motion path, said first direction is parallel to said linear motion path and said withdrawal conveyor is positioned in alignment with said linear motion path.

6. The apparatus of claim 1 wherein the assembly conveyor includes a base and an alignment member and wherein said sheet separator is located at the side of said magazine base which is directed toward the alignment member.

7. The apparatus of claim 1 wherein said magazine maintains vertical alignment of a received stack, said support plane is substantially horizontal and wherein said separator is positioned to operate on the lowermost sheet of a received stack of sheets and to tilt a corner region of the lowermost sheet downwardly with respect to said support plane.

8. The apparatus of claim 1 wherein the assembly conveyor defines a linear motion path and wherein said first direction and the withdrawal motion produced by said withdrawal conveyor are generally transverse to said linear motion path.

9. The apparatus of claim 8 wherein said separator and said air cushion producing means are located at a side of said magazine which faces in the upstream direction of said linear motion path.

10. The apparatus of claim 1 wherein said air cushion producing means comprises:

a nozzle assembly, said nozzle assembly being movable between a retracted position and an operative position, said nozzle assembly being at least partially inserted into said space between the lowermost and adjacent sheets when in the operative position.

11. The apparatus of claim 10 wherein said nozzle assembly, in said operative position, bears upon the stack in said open area.

12. The apparatus of claim 1 further comprising:

a transfer conveyor positioned between said withdrawal conveyor and the assembly conveyor, said transfer conveyor receiving withdrawn sheets from said withdrawal conveyor and moving said withdrawn sheets into registration with the assembly conveyor.

13. The apparatus of claim 12 wherein said transfer conveyor comprises a pair of cooperating driven conveyor belts, a withdrawn sheet being sandwiched between and thereby engaged by said belts, said transfer conveyor further comprising a support table.

14. The apparatus of claim 13 wherein said transfer conveyor defines an inclined motion path and the angle of inclination of said path is adjustable.

15. The apparatus of claim 1 wherein said movable magazine base comprises:

a reciprocal conveyor belt, said belt having a surface which frictionally engages the facing surface of the lowermost sheet of a stack of sheets received in said magazine.

16. The apparatus of claim 15 wherein said conveyor belt comprises a selectively operable vacuum conveyor, said belt being provided with an array of openings through which air may be drawn.

17. The apparatus of claim 15 wherein said withdrawal conveyor comprises:

rollers for frictionally engaging a folded sheet moving in said support plane through said magazine sheet discharge opening and accelerating the speed of movement thereof.

18. The apparatus of claim 17 wherein said air cushion producing means comprises:

a nozzle assembly, said nozzle assembly being movable between a retracted position and an operative position, said nozzle assembly being at least partially inserted into said space between the lowermost and adjacent sheets when in the operative position.

19. The apparatus of claim 18 wherein said reciprocating belt is provided with an array of apertures extending therethrough and wherein said apparatus further comprises:

means for selectively drawing air through said apertures of said array or delivering pressurized air to said apertures of said array whereby said belt functions as a vacuum conveyor during motion in said first direction and produces an air cushion between said base defined support plane and a stack of folded sheets in said magazine during motion of said base in a second direction opposite to said first direction.

* * * * *